US008097579B2

(12) United States Patent
Danziger et al.

(10) Patent No.: US 8,097,579 B2
(45) **Date of Patent: *Jan. 17, 2012**

(54) CLEANING COMPOSITIONS WITH AMPHIPHILIC WATER-SOLUBLE POLYALKYLENIMINES HAVING AN INNER POLYETHYLENE OXIDE BLOCK AND AN OUTER POLYPROPYLENE OXIDE BLOCK

(75) Inventors: James Lee Danziger, Mason, OH (US); Frank Hulskotter, Bad Duerkheim (DE); Dieter Boeckh, Limburgerhof (DE); Sophia Ebert, Mannheim (DE); Andrea Misske, Speyer (DE); Stefan Frenzel, Mannheim (DE)

(73) Assignee: The Procter & Gamble Company, Cincinnati, OH (US)

( * ) Notice: Subject to any disclaimer, the term of this patent is extended or adjusted under 35 U.S.C. 154(b) by 59 days.

This patent is subject to a terminal disclaimer.

(21) Appl. No.: 12/266,791

(22) Filed: Nov. 7, 2008

(65) Prior Publication Data

US 2009/0124531 A1 May 14, 2009

Related U.S. Application Data

(60) Provisional application No. 61/002,720, filed on Nov. 9, 2007.

(51) Int. Cl.
*C11D 3/37* (2006.01)
*C11D 3/30* (2006.01)

(52) U.S. Cl. ..... 510/499; 510/360; 510/421; 510/475; 8/137

(58) Field of Classification Search ..... 510/360, 510/421, 475, 499; 8/137
See application file for complete search history.

(56) References Cited

U.S. PATENT DOCUMENTS

| | | | | |
|---|---|---|---|---|
| 4,076,497 | A | 2/1978 | Freyberg et al. | |
| 5,565,145 | A | 10/1996 | Watson et al. | |
| 6,075,000 | A * | 6/2000 | Rohrbaugh et al. | 510/299 |
| 6,127,331 | A * | 10/2000 | Cleary et al. | 510/528 |
| 6,156,720 | A * | 12/2000 | Boeckh et al. | 510/475 |
| 6,262,011 | B1 | 7/2001 | Boeckh et al. | |
| 6,300,304 | B1 * | 10/2001 | Boeckh et al. | 510/475 |
| 2006/0234895 | A1 | 10/2006 | Souter et al. | |
| 2006/0234898 | A1 | 10/2006 | Schneiderman et al. | |
| 2007/0099815 | A1 | 5/2007 | Song et al. | |
| 2007/0105742 | A1 | 5/2007 | Scheibel et al. | |
| 2007/0275868 | A1 | 11/2007 | Cooremans et al. | |
| 2008/0153983 | A1 | 6/2008 | Boeckh et al. | |
| 2009/0014029 | A1 | 1/2009 | Borne et al. | |
| 2009/0124528 | A1 | 5/2009 | Danziger et al. | |
| 2009/0124529 | A1 | 5/2009 | Danziger et al. | |

FOREIGN PATENT DOCUMENTS

| | | | |
|---|---|---|---|
| DE | 22/27546 | A | 1/1974 |
| EP | 0359 034 | A1 | 3/1990 |
| JP | 2003/020585 | A | 1/2003 |
| WO | WO 99/01530 | * | 1/1999 |
| WO | WO 99/67352 | A1 | 12/1999 |
| WO | WO 2006/108856 | | 10/2006 |
| WO | WO 2006/108857 | * | 10/2006 |

OTHER PUBLICATIONS

PCT International Search Report mailed on Feb. 2, 2009.

U.S. Appl. No. 12/341,644, filed Dec. 22, 2008, Jean-Pol Boutique.

* cited by examiner

*Primary Examiner* — Brian P Mruk

(74) *Attorney, Agent, or Firm* — Stephen T. Murphy; Steven W. Miller; Leonard W. Lewis

(57) ABSTRACT

Laundry detergent and cleaning compositions comprising amphiphilic water-soluble alkoxylated polyalkylenimine polymer having an inner polyethylene oxide block comprising 20 to 50 polyethylene oxide units and an outer polypropylene oxide block comprising 10 to 50 polyethylene oxide units and especially to such alkoxylated polyalkylenimines wherein the ratio of polyethylene oxide units and polypropylene oxide units is proportionally related to the square root of the number of polyalkylenimine units present in the backbone.

15 Claims, No Drawings

CLEANING COMPOSITIONS WITH AMPHIPHILIC WATER-SOLUBLE POLYALKYLENIMINES HAVING AN INNER POLYETHYLENE OXIDE BLOCK AND AN OUTER POLYPROPYLENE OXIDE BLOCK

CROSS REFERENCE TO RELATED APPLICATIONS

This application claims priority under 35 U.S.C. §119(e) to U.S. Provisional Application Ser. No. 61/002,720 filed Nov. 9, 2007.

FIELD OF THE INVENTION

The present invention is directed to laundry compositions and cleaning compositions containing amphiphilic water-soluble alkoxylated polyalkylenimines having an inner polyethylene block and an outer polypropylene oxide block

BACKGROUND OF THE INVENTION

Detergent formulators are continuously faced with the task of devising products to remove a broad spectrum of soils and stains from fabrics. Chemically and physico-chemically, the varieties of soils and stains range the spectrum from polar soils, such as proteinaceous, clay, and inorganic soils, to non-polar soils, such as soot, carbon-black, byproducts of incomplete hydrocarbon combustion, and organic soils. The removal of greasy stains has been a particularly challenging problem. This challenge has been accentuated by the recent high interest and motivation to reduce the level of surfactants in cleaning detergents for environmental sustainability and cost reasons. The reduction of level of surfactants, especially oil-derived surfactants such as linear alkyl benzene sulfonate, LAS, has typically been found to lead to an erosion of greasy stain removal. Additionally, the global trend of using washing conditions at lower temperature further diminishes grease cleaning capabilities of typical detergents.

As a result of these trends, there is a need for new laundry and cleaning ingredients that provide hydrophobic and hydrophilic soil cleaning and whiteness maintenance. The material should exhibit good greasy soil detaching capability. They should also minimize the amount of suspended and emulsified soil from redepositing on the surfaces of the textiles or hard surfaces. Preferably, the new ingredient would also display a synergy with proteases for removing protease-sensitive stains like grass.

SUMMARY OF THE INVENTION

The present invention relates to novel laundry detergents and cleaning compositions comprising new amphiphilic water-soluble alkoxylated polyalkylenimine polymers that provide improved grease cleaning benefits, even at lower surfactant levels or at reduced temperatures. The new alkoxylated polyalkylenimine polymers comprise in condensed form repeating units of formulae (I), (II), (III) and (IV)

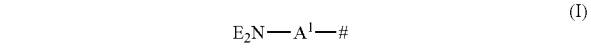

(I)

-continued

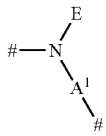

(II)

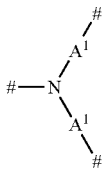

(III)

(IV)

wherein # in each case denotes one-half of a bond between a nitrogen atom and the free binding position of a group $A^1$ of two adjacent repeating units of formulae (I), (II), (III) or (IV); $A^1$ is independently selected from linear or branched $C_2$-$C_6$-alkylene; E is independently selected from alkylenoxy units of the formula (V)

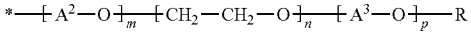

(V)

wherein * in each case denotes one-half of a bond to the nitrogen atom of the repeating unit of formula (I), (II) or (IV); $A^2$ is in each case independently selected from 1,2-propylene, 1,2-butylene and 1,2-isobutylene; $A^3$ is 1,2-propylene; R is in each case independently selected from hydrogen and $C_1$-$C_4$-alkyl; m has an average value in the range of from 0 to about 2; n has an average value in the range of from about 20 to about 50; and p has an average value in the range of from about 10 to about 50; wherein the individual alkoxylated polyalkylenimines consisting of 1 repeating unit of formula (I), x repeating units of formula (II), y repeating units of formula (III) and y+1 repeating units of formula (IV), wherein x and y in each case have a value in the range of from 0 to about 150; and the polymer having a backbone comprising the combined repeating units of formulae (I), (II), (III) and (IV) excluding the alkylenoxy units E, where the average molecular weight, Mw, of the polyalkylenimine backbone in each case having a value in the range of from about 60 to about 10,000 g/mol; and the polymer comprises a degree of quaternization ranging from 0 to about 50.

DETAILED DESCRIPTION OF THE INVENTION

Laundry Detergents and Cleaning Compositions

The inventive laundry detergents or cleaning compositions of the present invention comprise new amphiphilic water-soluble alkoxylated polyalkylenimine polymers. The alkoxylated polyalkylenimine polymers comprise in condensed form, repeating units of formulae (I), (II), (III) and (IV)

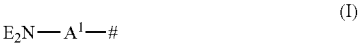

(I)

-continued (II)

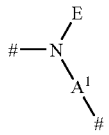

(III)

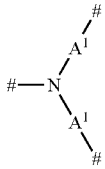

(IV)

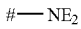

wherein:

in each case denotes one-half of a bond between a nitrogen atom and the free binding position of a group $A^1$ of two adjacent repeating units of formulae (I), (II), (III) or (IV);

$A^1$ is independently selected from linear or branched $C_2$-$C_6$-alkylene;

E is independently selected from alkylenoxy units of the formula (V)

(V)

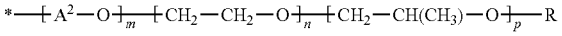

wherein:

in each case denotes the bond to the nitrogen atom of the repeating unit of formula (I), (II) or (IV);

$A^2$ is in each case independently selected from 1,2-propylene, 1,2-butylene and 1,2-isobutylene;

R is in each case independently selected from hydrogen and $C_1$-$C_4$-alkyl;

m has an average value in the range of from 0 to about 2;

n has an average value in the range of from about 20 to about 50; and p is a rational number from about 10 to about 50;

the individual alkoxylated polyalkylenimines consisting of 1 repeating unit of formula (I), x repeating units of formula (II), y repeating units of formula (III) and y+1 repeating units of formula (IV), wherein x and y in each case have a value in the range of from 0 to about 150; and the average molecular weight Mw of the polyalkylenimine backbone in each case having a value in the range of from about 60 to about 10,000 g/mol; and the polymer has a degree of quaternization of from 0 to about 50%.

The alkoxylated polyalkylenimines according to the present invention are generally obtained as a mixture of different individual alkoxylated polyalkylenimines. Therefore, unless otherwise indicated, the values, ranges and ratios given in the specification for m, n, p, x, y and the molecular weight (Mw) relate to the number average values of the individual alkoxylated polyalkylenimines present in the mixture obtained.

Due to their amphiphilicity the alkoxylated polyalkylenimines according to the invention have a balanced ratio of hydrophobic and hydrophilic structural elements and are on the one hand hydrophobic enough to absorb an greasy soil and to remove them together with the surfactants and the remaining washing components of the laundry detergents and cleaning compositions, and on the other hand hydrophilic enough to keep the detached greasy soil in the washing and cleaning liquor and prevent it from resettling an the surface.

An essential feature of the alkoxylated polyalkylenimines according to the present invention compared to previously described alkoxylated polyalkylenimines is their extended side-chains, i.e. they have significantly longer amphiphilic polyalkoxy-chains and generally larger individual block-sizes of the hydrophilic polyethylenoxide-blocks and the hydrophobic polypropylenoxide-blocks. Without being limited by theory, it is believed that these longer side-chains support a better stabilization of soils in the washing- or cleaning-liquor. Thus, the re-deposition of the soils to the cleaned goods is prevented. Another important advantage of the alkoxylated polyalkylenimines according to the invention is their enhanced color- and odor-profile. While alkoxylated polyalkylenimines with shorter side-chains are generally dark in color and have a characteristic odor it has been found, that the alkoxylated polyalkylenimines according to the present invention have much lower levels of both.

These effects are achieved by the alkoxylated polyalkylenimines having an inner polyethylene oxide block and an outer polypropylene oxide block, the degree of ethoxylation and the degree of propoxylation not going above or below specific limiting values. Specific embodiments of the alkoxylated polyalkylenimines according to the present invention have a minimum ratio of polyethylene blocks to polypropylene blocks (n/p) of about 0.6 and a maximum of about $1.5(x+2y+1)^{1/2}$. Alkoxykated polyalkyenimines having an n/p ratio of from about 0.8 to about $1.2(x+2y+1)^{1/2}$ have been found to have especially beneficial properties.

The alkoxylated polyalkylenimines according to the present invention have a backbone which consists of primary, secondary and tertiary amine nitrogen atoms which are attached to one another by alkylene radicals A and are randomly arranged. Primary amino moieties which start or terminate the main chain and the side chains of the polyalkylenimine backbone and whose remaining hydrogen atoms are subsequently replaced by alkylenoxy units are referred to as repeating units of formulae (I) or (IV), respectively. Secondary amino moieties whose remaining hydrogen atom is subsequently replaced by alkylenoxy units are referred to as repeating units of formula (II). Tertiary amino moieties which branch the main chain and the side chains are referred to as repeating units of formula (III).

Since cyclization can occur in the formation of the polyalkylenimine backbone, it is also possible for cyclic amino moieties to be present to a small extent in the backbone. Such polyalkylenimines containing cyclic amino moieties are of course alkoxylated in the same way as those consisting of the noncyclic primary and secondary amino moieties.

The polyalkylenimine backbone consisting of the nitrogen atoms and the groups $A^1$, has an average molecular weight Mw of from about 60 to about 10,000 g/mole, preferably from about 100 to about 8,000 g/mole and more preferably from about 500 to about 6,000 g/mole.

The sum (x+2y+1) corresponds to the total number of alkylenimine units present in one individual polyalkylenimine backbone and thus is directly related to the molecular weight of the polyalkylenimine backbone. The values given in the specification however relate to the number average of all polyalkylenimines present in the mixture. The sum (x+2y+2) corresponds to the total number amino groups present in one individual polyalkylenimine backbone.

The radicals $A^1$ connecting the amino nitrogen atoms may be identical or different, linear or branched $C_2$-$C_6$-alkylene radicals, such as 1,2-ethylene, 1,2-propylene, 1,2-butylene, 1,2-isobutylene, 1,2-pentanediyl, 1,2-hexanediyl or hexamethylen. A preferred branched alkylene is 1,2-propylene. Preferred linear alkylene are ethylene and hexamethylene. A more preferred alkylene is 1,2-ethylene.

The hydrogen atoms of the primary and secondary amino groups of the polyalkylenimine backbone are replaced by alkylenoxy units of the formula (V).

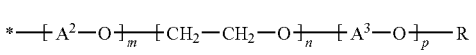

(V)

In this formula, the variables preferably have one of the meanings given below:

$A^2$ in each case is selected from 1,2-propylene, 1,2-butylene and 1,2-isobutylene; preferably $A^2$ is 1,2-propylene. $A^3$ is 1,2-propylene; R in each case is selected from hydrogen and $C_1$-$C_4$-alkyl, such as methyl, ethyl, n-propyl, isopropyl, n-butyl, isobutyl and tert.-butyl; preferably R is hydrogen. The index m in each case has a value of 0 to about 2; preferably m is 0 or approximately 1; more preferably m is 0. The index n has an average value in the range of from about 20 to about 50, preferably in the range of from about 22 to about 40, and more preferably in the range of from about 24 to about 30. The index p has an average value in the range of from about 10 to about 50, preferably in the range of from about 11 to about 40, and more preferably in the range of from about 12 to about 30.

Preferably the alkylenoxy unit of formula (V) is a non-random sequence of alkoxylate blocks. By non-random sequence it is meant that the $[\text{-}A^2\text{-O—}]_m$ is added first (i.e., closest to the bond to the nitrogen atom of the repeating unit of formula (I), (II), or (III)), the $[\text{—}CH_2\text{—}CH_2\text{—O—}]_n$ is added second, and the $[\text{-}A^3\text{-O—}]_p$ is added third. This orientation provides the alkoxylated polyalkylenimine with an inner polyethylene oxide block and an outer polypropylene oxide block.

The substantial part of these alkylenoxy units of formula (V) is formed by the ethylenoxy units $\text{—}[CH_2\text{—}CH_2\text{—O)}]_n\text{—}$ and the propylenoxy units $\text{—}[CH_2\text{—}CH_2(CH_3)\text{—O}]_p\text{—}$. The alkylenoxy units may additionally also have a small proportion of propylenoxy or butylenoxy units $\text{-}[A^2\text{-O}]_m\text{—}$, i.e. the polyalkylenimine backbone saturated with hydrogen atoms may be reacted initially with small amounts of up to about 2 mol, especially from about 0.5 to about 1.5 mol, in particular from about 0.8 to about 1.2 mol, of propylene oxide or butylene oxide per mole of NH— moieties present, i.e. incipiently alkoxylated.

This initial modification of the polyalkylenimine backbone allows, if necessary, the viscosity of the reaction mixture in the alkoxylation to be lowered. However, the modification generally does not influence the performance properties of the alkoxylated polyalkylenimine and therefore does not constitute a preferred measure.

The alkoxylated polyalkylenimines according to the present invention may also be quaternized. A suitable degree of quaternization is up to 50%, in particular from 5 to 40%. The quaternization is effected preferably by introducing $C_1$-$C_4$-alkyl groups and may be undertaken in a customary manner by reaction with corresponding alkyl halides and dialkyl sulfates. The quaternization may be advantageous in order to adjust the alkoxylated polyalkylenimines to the particular composition of the laundry detergent and cleaning composition in which they are to be used, and to achieve better compatibility and/or phase stability of the formulation. The alkoxylated polyalkylenimines are preferably not quaternized.

The inventive alkoxylated polyalkylenimines may be prepared in a known manner. One preferred procedure consists in initially undertaking only an incipient alkoxylation of the polyalkylenimine in a first step. In this step, the polyalkylenimine is reacted only with a portion of the total amount of ethylene oxide used, which corresponds to about 1 mol of ethylene oxide per mole of NH moiety or, when the polyalkylenimine is to be modified initially with up to about 2 mol of propylene oxide or butylene oxide per mole of NH moiety, here too initially only with up to 1 mol of this alkylene oxide. This reaction is undertaken generally in the absence of a catalyst in an aqueous solution at a reaction temperature from about 70 to about 200° C. and preferably from about 80 to about 160° C. This reaction may be affected at a pressure of up to about 10 bar, and in particular up to about 8 bar.

In a second step, the further alkoxylation is then effected by subsequent reaction i) with the remaining amount of ethylene oxide or, in the case of a modification by higher alkylene oxide in the first step, with the entirety of ethylene oxide and ii) with propylene oxide. The further alkoxylation is undertaken typically in the presence of a basic catalyst. Examples of suitable catalysts are alkali metal and alkaline earth metal hydroxides such as sodium hydroxide, potassium hydroxide and calcium hydroxide, alkali metal alkoxides, in particular sodium and potassium $C_1$-$C_4$-alkoxides, such as sodium methoxide, sodium ethoxide and potassium tert-butoxide, alkali metal and alkaline earth metal hydrides such as sodium hydride and calcium hydride, and alkali metal carbonates such as sodium carbonate and potassium carbonate. Preference is given to the alkali metal hydroxides and the alkali metal alkoxides, particular preference being given to potassium hydroxide and sodium hydroxide. Typical use amounts for the base are from 0.05 to 10% by weight, in particular from 0.5 to 2% by weight, based on the total amount of polyalkylenimine and alkylene oxide.

The further alkoxylation may be undertaken in substance (variant a)) or in an organic solvent (variant b)). The process conditions specified below may be used both for the ethoxylation and for the subsequent propoxylation. In variant a), the aqueous solution of the incipiently alkoxylated polyalkylenimine obtained in the first step, after addition of the catalyst, is initially dewatered. This can be done in a simple manner by heating to from about 80 to about 150° C. and distilling off the water under a reduced pressure of from about 0.01 to about 0.5 bar. The subsequent reaction with the alkylene oxide is effected typically at a reaction temperature from about 70 to about 200° C. and preferably from about 100 to about 180° C. The subsequent reaction with the alkylene oxide is effected typically at a pressure of up to about 10 bar and in particular up to 8 bar. The reaction time of the subsequent reaction with the alkylene oxide is generally about 0.5 to about 4 hours.

Suitable organic solvents for variant b) are in particular nonpolar and polar aprotic organic solvents. Examples of particularly suitable nonpolar aprotic solvents include aliphatic and aromatic hydrocarbons such as hexane, cyclohexane, toluene and xylene. Examples of particularly suitable polar aprotic solvents are ethers, in particular cyclic ethers such as tetrahydrofuran and dioxane, N,N-dialkylamides such as dimethylformamide and dimethylacetamide, and N-alkyllactams such as N methylpyrrolidone. It is of course also possible to use mixtures of these organic solvents. Preferred organic solvents are xylene and toluene.

In variant b), the solution obtained in the first step, after addition of catalyst and solvent, is initially dewatered, which is advantageously done by separating out the water at a temperature of from about 120 to about 180° C., preferably supported by a gentle nitrogen stream. The subsequent reaction with the alkylene oxide may be effected as in variant a). In variant a), the alkoxylated polyalkylenimine is obtained directly in substance and may be converted if desired to an aqueous solution. In variant b), the organic solvent is typically removed and replaced by water. The products may, of course, also be isolated in substance.

The alkoxylated polyalkylenimines according to the present invention, as a 1% by weight solution in distilled water, have a cloud point of generally equal to or greater than about 70° C., preferably equal to or greater than about 65° C. The cloud point is more preferably in the range from about 25 to about 55° C.

The alkoxylated polyalkylenimines according to the present invention are outstandingly suitable as a soil detachment-promoting additive for laundry detergents and cleaning compositions. They exhibit high dissolving power especially in the case of greasy soil. It is of particular advantage that they display the soil-detaching power even at low washing temperatures.

The alkoxylated polyalkylenimines according to the present invention can be added to the laundry detergents and cleaning compositions in amounts of generally from 0.05 to 10% by weight, preferably from 0.1 to 5% by weight and more preferably from 0.25 to 2.5% by weight, based on the particular overall composition.

In addition, the laundry detergents and cleaning compositions generally comprise surfactants and, if appropriate, other polymers as washing substances, builders and further customary ingredients, for example cobuilders, complexing agents, bleaches, standardizers, graying inhibitors, dye transfer inhibitors, enzymes and perfumes.

The alkoxylated polyalkylenimine polymers of the present invention may be utilized in laundry detergents or cleaning compositions comprising a surfactant system comprising $C_{10}$-$C_{16}$ alkyl benzene sulfonates (LAS) and one or more co-surfactants selected from nonionic, cationic, anionic or mixtures thereof. Alternately, the multi-polymer system of the present invention may be utilized in laundry detergents or cleaning compositions comprising surfactant systems comprising any anionic surfactant or mixture thereof with nonionic surfactants and/or fatty acids, optionally complemented by zwitterionic or so-called semi-polar surfactants such as the $C_{12}$-$C_{16}$ alkyldimethylamine N-oxides can also be used. In other embodiments, the surfactant used can be exclusively anionic or exclusively nonionic. Suitable surfactant levels are from about 0.5% to about 80% by weight of the detergent composition, more typically from about 5% to about 60% by weight.

A preferred class of anionic surfactants are the sodium, potassium and alkanolammonium salts of the $C_{10}$-$C_{16}$ alkylbenzenesulfonates which can be prepared by sulfonation (using $SO_2$ or $SO_3$) of alkylbenzenes followed by neutralization. Suitable alkylbenzene feedstocks can be made from olefins, paraffins or mixtures thereof using any suitable alkylation scheme, including sulfuric and HF-based processes. Any suitable catalyst may be used for the alkylation, including solid acid catalysts such as DETAL™ solid acid catalyst available commercially from UOP, a Honeywell company. Such solid acid catalysts include DETAL™ DA-114 catalyst and other solid acid catalysts described in patent applications to UOP, Petresa, Huntsman and others. It should be understood and appreciated that, by varying the precise alkylation catalyst, it is possible to widely vary the position of covalent attachment of benzene to an aliphatic hydrocarbon chain. Accordingly alkylbenzene sulfonates useful herein can vary widely in 2-phenyl isomer and/or internal isomer content.

The selection of co-surfactant may be dependent upon the desired benefit. In one embodiment, the co-surfactant is selected as a nonionic surfactant, preferably $C_{12}$-$C_{18}$ alkyl ethoxylates. In another embodiment, the co-surfactant is selected as an anionic surfactant, preferably $C_{10}$-$C_{18}$ alkyl alkoxy sulfates ($AE_xS$) wherein x is from 1-30. In another embodiment the co-surfactant is selected as a cationic surfactant, preferably dimethyl hydroxyethyl lauryl ammonium chloride. If the surfactant system comprises $C_{10}$-$C_{15}$ alkyl benzene sulfonates (LAS), the LAS is used at levels ranging from about 9% to about 25%, or from about 13% to about 25%, or from about 15% to about 23% by weight of the composition.

In one embodiment, the surfactant system may comprise from 0% to about 7%, or from about 0.1% to about 5%, or from about 1% to about 4% by weight of the composition of a co-surfactant selected from a nonionic co-surfactant, cationic co-surfactant, anionic co-surfactant and any mixture thereof.

Non-limiting examples of nonionic co-surfactants include: $C_{12}$-$C_{18}$ alkyl ethoxylates, such as, NEODOL® nonionic surfactants from Shell; $C_6$-$C_{12}$ alkyl phenol alkoxylates wherein the alkoxylate units are a mixture of ethyleneoxy and propyleneoxy units; $C_{12}$-$C_{18}$ alcohol and $C_6$-$C_{12}$ alkyl phenol condensates with ethylene oxide/propylene oxide block alkyl polyamine ethoxylates such as PLURONIC® from BASF; $C_{14}$-$C_{22}$ mid-chain branched alcohols, BA, as discussed in U.S. Pat. No. 6,150,322; $C_{14}$-$C_{22}$ mid-chain branched alkyl alkoxylates, $BAE_x$, wherein x is from 1-30, as discussed in U.S. Pat. No. 6,153,577, U.S. Pat. No. 6,020,303 and U.S. Pat. No. 6,093,856; alkylpolysaccharides as discussed in U.S. Pat. No. 4,565,647 Llenado, issued Jan. 26, 1986; specifically alkylpolyglycosides as discussed in U.S. Pat. No. 4,483,780 and U.S. Pat. No. 4,483,779; polyhydroxy fatty acid amides as discussed in U.S. Pat. No. 5,332,528; and ether capped poly(oxyalkylated) alcohol surfactants as discussed in U.S. Pat. No. 6,482,994 and WO 01/42408. Also useful herein as nonionic surfactants or co-surfactants are alkoxylated ester surfactants such as those having the formula $R^1C(O)O(R^2O)_nR^3$ wherein $R^1$ is selected from linear and branched $C_6$-$C_{22}$ alkyl or alkylene moieties; $R^2$ is selected from $C_2H_4$ and $C_3H_6$ moieties and $R^3$ is selected from H, $CH_3$, $C_2H_5$ and $C_3H_7$ moieties; and n has a value between 1 and 20. Such alkoxylated ester surfactants include the fatty methyl ester ethoxylates (MEE) and are well-known in the art; see for example U.S. Pat. No. 6,071,873; U.S. Pat. No. 6,319,887; U.S. Pat. No. 6,384,009; U.S. Pat. No. 5,753,606; WO 01/10391, WO 96/23049.

Non-limiting examples of semi-polar nonionic co-surfactants include: water-soluble amine oxides containing one alkyl moiety of from about 10 to about 18 carbon atoms and 2 moieties selected from the group consisting of alkyl moieties and hydroxyalkyl moieties containing from about 1 to about 3 carbon atoms; water-soluble phosphine oxides containing one alkyl moiety of from about 10 to about 18 carbon atoms and 2 moieties selected from the group consisting of alkyl moieties and hydroxyalkyl moieties containing from about 1 to about 3 carbon atoms; and water-soluble sulfoxides containing one alkyl moiety of from about 10 to about 18 carbon atoms and a moiety selected from the group consisting of alkyl moieties and hydroxyalkyl moieties of from about 1 to about 3 carbon atoms. See WO 01/32816, U.S. Pat. No. 4,681,704, and U.S. Pat. No. 4,133,779.

Non-limiting examples of cationic co-surfactants include: the quaternary ammonium surfactants, which can have up to 26 carbon atoms include: alkoxylate quaternary ammonium (AQA) surfactants as discussed in U.S. Pat. No. 6,136,769;

dimethyl hydroxyethyl quaternary ammonium as discussed in U.S. Pat. No. 6,004,922; dimethyl hydroxyethyl lauryl ammonium chloride; polyamine cationic surfactants as discussed in WO 98/35002, WO 98/35003, WO 98/35004, WO 98/35005, and WO 98/35006; cationic ester surfactants as discussed in U.S. Pat. Nos. 4,228,042, 4,239,660 4,260,529 and U.S. Pat. No. 6,022,844; and amino surfactants as discussed in U.S. Pat. No. 6,221,825 and WO 00/47708, specifically amido propyldimethyl amine (APA).

Nonlimiting examples of anionic co-surfactants useful herein include: $C_{10}$-$C_{20}$ primary, branched chain and random alkyl sulfates (AS); $C_{10}$-$C_{18}$ secondary (2,3) alkyl sulfates; $C_{10}$-$C_{18}$ alkyl alkoxy sulfates ($AE_xS$) wherein x is from 1-30; $C_{10}$-$C_{18}$ alkyl alkoxy carboxylates comprising 1-5 ethoxy units; mid-chain branched alkyl sulfates as discussed in U.S. Pat. No. 6,020,303 and U.S. Pat. No. 6,060,443; mid-chain branched alkyl alkoxy sulfates as discussed in U.S. Pat. No. 6,008,181 and U.S. Pat. No. 6,020,303; modified alkylbenzene sulfonate (MLAS) as discussed in WO 99/05243, WO 99/05242 and WO 99/05244; methyl ester sulfonate (MES); and alpha-olefin sulfonate (AOS). Anionic surfactants herein may be used in the form of their sodium, potassium or alkanolamine salts.

The present invention may also relates to compositions comprising the inventive alkoxylated polyalkylenimine polymers and a surfactant system comprising $C_8$-$C_{18}$ linear alkyl sulphonate surfactant and a co-surfactant. The compositions can be in any form, namely, in the form of a liquid; a solid such as a powder, granules, agglomerate, paste, tablet, pouches, bar, gel; an emulsion; types delivered in dual-compartment containers; a spray or foam detergent; premoistened wipes (i.e., the cleaning composition in combination with a nonwoven material such as that discussed in U.S. Pat. No. 6,121,165, Mackey, et al.); dry wipes (i.e., the cleaning composition in combination with a nonwoven materials, such as that discussed in U.S. Pat. No. 5,980,931, Fowler, et al.) activated with water by a consumer; and other homogeneous or multiphase consumer cleaning product forms. The composition may alternatively be in the form of a tablet or pouch, including multi-compartment pouches.

In one embodiment, the cleaning composition of the present invention is a liquid or solid laundry detergent composition. In another embodiment, the cleaning composition of the present invention is a hard surface cleaning composition, preferably wherein the hard surface cleaning composition impregnates a nonwoven substrate. As used herein "impregnate" means that the hard surface cleaning composition is placed in contact with a nonwoven substrate such that at least a portion of the nonwoven substrate is penetrated by the hard surface cleaning composition, preferably the hard surface cleaning composition saturates the nonwoven substrate. The cleaning composition may also be utilized in car care compositions, for cleaning various surfaces such as hard wood, tile, ceramic, plastic, leather, metal, glass. This cleaning composition could be also designed to be used in a personal care and pet care compositions such as shampoo composition, body wash, liquid or solid soap and other cleaning composition in which surfactant comes into contact with free hardness and in all compositions that require hardness tolerant surfactant system, such as oil drilling compositions.

In another embodiment the cleaning composition is a dish cleaning composition, such as liquid hand dishwashing compositions, solid automatic dishwashing compositions, liquid automatic dishwashing compositions, and tab/unit does forms of automatic dishwashing compositions.

Quite typically, cleaning compositions herein such as laundry detergents, laundry detergent additives, hard surface cleaners, synthetic and soap-based laundry bars, fabric softeners and fabric treatment liquids, solids and treatment articles of all kinds will require several adjuncts, though certain simply formulated products, such as bleach additives, may require only, for example, an oxygen bleaching agent and a surfactant as described herein. A comprehensive list of suitable laundry or cleaning adjunct materials can be found in WO 99/05242.

Common cleaning adjuncts include builders, enzymes, polymers not discussed above, bleaches, bleach activators, catalytic materials and the like excluding any materials already defined hereinabove. Other cleaning adjuncts herein can include suds boosters, suds suppressors (antifoams) and the like, diverse active ingredients or specialized materials such as dispersant polymers (e.g., from BASF Corp. or Rohm & Haas) other than those described above, color speckles, silvercare, anti-tarnish and/or anti-corrosion agents, dyes, fillers, germicides, alkalinity sources, hydrotropes, anti-oxidants, enzyme stabilizing agents, pro-perfumes, perfumes, solubilizing agents, carriers, processing aids, pigments, and, for liquid formulations, solvents, chelating agents, dye transfer inhibiting agents, dispersants, brighteners, suds suppressors, dyes, structure elasticizing agents, fabric softeners, anti-abrasion agents, hydrotropes, processing aids, and other fabric care agents, surface and skin care agents. Suitable examples of such other cleaning adjuncts and levels of use are found in U.S. Pat. Nos. 5,576,282, 6,306,812 B1 and 6,326,348 B1.

Method of Use

The present invention includes a method for cleaning a targeted surface. As used herein "targeted surface" may include such surfaces such as fabric, dishes, glasses, and other cooking surfaces, hard surfaces, hair or skin. As used herein "hard surface" includes hard surfaces being found in a typical home such as hard wood, tile, ceramic, plastic, leather, metal, glass. Such method includes the steps of contacting the composition comprising the modified polyol compound, in neat form or diluted in wash liquor, with at least a portion of a targeted surface then optionally rinsing the targeted surface. Preferably the targeted surface is subjected to a washing step prior to the aforementioned optional rinsing step. For purposes of the present invention, washing includes, but is not limited to, scrubbing, wiping and mechanical agitation.

As will be appreciated by one skilled in the art, the cleaning compositions of the present invention are ideally suited for use in home care (hard surface cleaning compositions) and/or laundry applications.

The composition solution pH is chosen to be the most complimentary to a target surface to be cleaned spanning broad range of pH, from about 5 to about 11. For personal care such as skin and hair cleaning pH of such composition preferably has a pH from about 5 to about 8 for laundry cleaning compositions pH of from about 8 to about 10. The compositions are preferably employed at concentrations of from about 200 ppm to about 10,000 ppm in solution. The water temperatures preferably range from about 5° C. to about 100° C.

For use in laundry cleaning compositions, the compositions are preferably employed at concentrations from about 200 ppm to about 10000 ppm in solution (or wash liquor). The water temperatures preferably range from about 5° C. to about 60° C. The water to fabric ratio is preferably from about 1:1 to about 20:1.

The method may include the step of contacting a nonwoven substrate impregnated with an embodiment of the composition of the present invention As used herein "nonwoven substrate" can comprise any conventionally fashioned nonwoven sheet or web having suitable basis weight, caliper (thickness), absorbency and strength characteristics. Examples of suitable commercially available nonwoven substrates include those marketed under the tradename SONTARA® by DuPont and POLYWEB® by James River Corp.

As will be appreciated by one skilled in the art, the cleaning compositions of the present invention are ideally suited for use in liquid dish cleaning compositions. The method for using a liquid dish composition of the present invention comprises the steps of contacting soiled dishes with an effective amount, typically from about 0.5 ml. to about 20 ml. (per 25 dishes being treated) of the liquid dish cleaning composition of the present invention diluted in water.

POLYMER EXAMPLES

I. Preparation of Inventive Alkoxylated Polyalkylenimines

Example 1

PE1600+24EO/NH+16PO/NH a) PEI600+1EO/NH—In a 3.5 L autoclave of a polyethyleneimine (1184.0 g, approx. average Mw=600 g/mol) and water (205.0 g) were heated to 80° C. The autoclave was purged three times with nitrogen up to a pressure of 5 bar. After increasing the temperature to 120° C. ethylene oxide (908.7 g) was added in portions. The pressure was raised to 7 bar. To complete the reaction, the mixture was allowed to post-react for 2 h at 120° C. The reaction mixture was stripped with nitrogen and volatile compounds were removed in vacuo at 70° C. This procedure yielded 2305 g of a 91% by weight aqueous solution of polyethyleneimine alkoxylated by 1 mole of ethylene oxide per mole of NH-bond as a yellow viscous liquid. Amine titer: 11.22 mmol/g; pH (of 1% by weight aq. solution): 11.06.

b) PEI600+24EO/NH—In a 2 L autoclave the aqueous solution obtained in example 1.a) (108.6 g) and an aqueous solution of potassium hydroxide (50% by weight, 2.9 g) were heated to 80° C. The autoclave was purged three times with nitrogen up to a pressure of 5 bar. Water was removed from the reaction mixture at 120° C. and at a pressure of 10 mbar for 2 h. After flushing the autoclave with nitrogen, the temperature was increased to 145° C. and ethylene oxide (1329.9 g) was added in portions. The pressure was raised up to 5 bar. To complete the reaction, the mixture was allowed to post-react for 3 h at 120° C. The reaction mixture was stripped with nitrogen and volatile compounds were removed in vacuo at 70° C. This procedure yielded 1428 g of polyethyleneimine alkoxylated by 24 mole of ethylene oxide per mole of NH-bond as a yellow-brown viscous liquid. Amine titer: 0.82 mmol/g; pH (of 1% by weight aq. solution): 10.6.

c) PEI 600+24EO/NH+16PO/NH—In a 2 L autoclave 460.9 g of the alkoxylated polyethyleneimine obtained in example 1.b) was heated to 80° C. and purged three times with nitrogen up to a pressure of 5 bar. After increasing the temperature to 140° C., propylene oxide (389.1 g) was added in portions. The pressure was raised up to 5 bar. To complete the reaction, the mixture was allowed to post-react for 5 h at 140° C. The reaction mixture was stripped with nitrogen and volatile compounds were removed in vacuo at 70° C. This procedure yielded 838 g of a polyethyleneimine which contained 24 mole of ethylene oxide and 16 mole propylene oxide per mole of NH bond as a yellow viscous liquid. Amine titer: 0.59 mmol/g; pH of a 1% by weight aq. solution: 9.7; Iodine color number of pure compound: 7.9.

Example 2

PEI 600+24EO/NH+24PO/NH a) PEI 600+24EO/NH+24PO/NH—In a 2 L autoclave the alkoxylated polyethyleneimine obtained in example 1.b) (341.3 g) was heated to 80° C. The autoclave was purged three times with nitrogen up to a pressure of 5 bar. After increasing the temperature to 140° C. propylene oxide (425.5 g) was added in portions. The pressure was raised up to 6 bar. To complete the reaction, the mixture was allowed to post-react for 5 h at 140° C. The reaction mixture was stripped with nitrogen and volatile compounds were removed in vacuo at 80° C. This procedure yielded 780 g of a polyethyleneimine alkoxylated with 24 mole of ethylene oxide and 24 mole propylene oxide per mole of NH— bonds as a yellow viscous liquid. Amine titer: 0.36 mmol/g; pH (1% by weight aq. solution): 9.1; Iodine color number (pure compound, 40° C.): 7.3.

Example 3

DETA+24EO/NH+24PO/NH a) DETA+1 EO/NH—In a 2 L autoclave diethylene triamine (381.8 g) and water (19.1 g) were heated to 70° C. The autoclave was purged three times with nitrogen up to a pressure of 5 bar. After the temperature had been increased to 90° C. ethylene oxide (814 g) was added in portions. The pressure was raised up to 3 bar. To complete the reaction, the mixture was allowed to post-react for 2 h at 90° C. The reaction mixture was stripped with nitrogen and volatile compounds were removed in vacuo at 70° C. This procedure yielded 1180 g of diethylene triamine alkoxylated with 1 mole of ethylene oxide per mole of NH— bonds as a yellow viscous liquid.

b) DETA+24EO/NH—In a 2 L autoclave diethylene triamine alkoxylated with 1 mole of ethylene oxide per mole NH bond obtained in example 3.a) (79.7 g) and an aqueous solution of potassium hydroxide (50% by weight, 2.9 g) were heated to 80° C. The autoclave was purged three times with nitrogen up to a pressure of 5 bar. Water was removed from the reaction mixture at 100° C. and a pressure of 10 mbar for 2 h. After the flushing the autoclave with nitrogen, the temperature was increased to 120° C. and ethylene oxide (1266.1 g) was added in portions. The pressure was raised up to 5 bar. To complete the reaction, the mixture was allowed to post-react for 3 h at 120° C. The reaction mixture was stripped with nitrogen and volatile compounds were removed in vacuo at 80° C. This procedure yielded 1366 g of diethylene triamine alkoxylated with 24 mole of ethylene oxide per mole of NH-bond as a brown solid. Amine titer: 0.58 mmol/g; pH (1% by weight aq. solution): 10.4.

c) DETA+24EO/NH+24PO/NH—In a 2 L autoclave diethylene triamine alkoxylated with 24 mole of ethylene oxide per mole NH— bond obtained in example 3.b) (310.6 g) was heated to 80° C. The autoclave was purged three times with nitrogen up to a pressure of 5 bar. After flushing the autoclave with nitrogen, the temperature was increased to 140° C. and propylene oxide (396.7 g) was added in portions. The pressure was raised up to 4 bar. To complete the reaction, the mixture was allowed to post-react for 5 h at 140° C. The reaction mixture was stripped with nitrogen and volatile compounds were removed in vacuo at 80° C. This procedure yielded 705 g of diethylene triamine alkoxylated with 24 mole of ethylene oxide and 24 mole propylene oxide per mole of NH-bonds as a light brown solid. Amine titer: 0.26 mmol/g, pH (1% by weight aq. solution): 10.0; Iodine colour number (pure compound, 40° C.): 2.9.

Example 4

Hexamethylene diamine+24EO/NH+16PO/NH a) Hexamethylene diamine+1 EO/NH—In a 2 L autoclave hexamethylene diamine (527 g) and water (26.5 g) were heated to 70° C. The autoclave was purged three times with nitrogen up to a pressure of 5 bar. After increasing the temperature to 90° C. ethylene oxide (800 g) was added in portions. The pressure was raised up to 6 bar. To complete the reaction, the mixture was allowed to post-react for 3 h at 90° C. The reaction mixture was stripped with nitrogen and volatile compounds were removed in vacuo at 70° C. This procedure yielded 1356 g of hexamethylene diamine alkoxylated with 1 mole of ethylene oxide per mole of NH— bonds as a light yellow solid. Amine titer: 6.70 mmol/g.

b) Hexamethylene diamine+24EO/NH+16PO/NH—In a 2 L autoclave the hexamethylene diamine alkoxylated with 1 mole of ethylene oxide per mole NH— bonds obtained in example 4.a) (45.0 g) and an aqueous solution of potassium hydroxide (50% by weight, 1.4 g) were heated to 80° C. The autoclave was purged three times with nitrogen up to a pressure of 5 bar. Water was removed from the mixture at 100° C. and at a pressure of 10 mbar for 2 h. After flushing the autoclave with nitrogen, the temperature was increased to 120° C. and ethylene oxide (623.2 g) was added in portions. The pressure was raised up to 6 bar. To complete the reaction, the mixture was allowed to post-react for 3 h at 120° C. After the temperature had been increased to 140° C. propylene oxide (571.5 g) was added in portions. The pressure was raised up to 6 bar. To complete the reaction, the mixture was allowed to post-react for 5 h at 140° C. The reaction mixture was stripped with nitrogen and volatile compounds were removed in vacuo at 80° C. This procedure yielded 1250 g of hexamethylene diamine alkoxylated with 24 mole of ethylene oxide and 16 mole propylene oxide per mole of NH— bonds as a yellow-light brown solid. Amine titer: 0.25 mmol/g; pH (1% by weight aq. solution): 10.3; Iodine colour number (pure compound, 40° C.): 1.3.

Composition Formulations

Example 5

Granular Laundry Detergent

| Formula | A wt% | B wt% | C wt% | D wt% | E wt% |
|---|---|---|---|---|---|
| $C_{11-12}$ Linear alkyl benzene sulphonate | 13-25 | 13-25 | 13-25 | 13-25 | 9-25 |
| $C_{12-18}$ Ethoxylate Sulfate | — | — | 0-3 | — | 0-1 |
| $C_{14-15}$ alkyl ethoxylate (EO = 7) | 0-3 | 0-3 | — | 0-5 | 0-3 |
| Dimethyl hydroxyethyl lauryl ammonium chloride | — | — | 0-2 | 0-2 | 0-2 |
| $C_{8-10}-N^{+}(CH_3)_2-(CH_2CH_2)OH$ | 20-40 | — | 18-33 | 12-22 | 0-15 |
| Sodium tripolyphosphate K1 | | | | | |
| Zeolite | 0-10 | 20-40 | 0-3 | — | — |
| Silicate builder | 0-10 | 0-10 | 0-10 | 0-10 | 0-10 |
| Carbonate | 0-30 | 0-30 | 0-30 | 5-25 | 0-20 |
| Diethylene triamine penta acetate | 0-1 | 0-1 | 0-1 | 0-1 | 0-1 |
| Polyacrylate | 0-3 | 0-3 | 0-3 | 0-3 | 0-3 |
| Carboxy Methyl Cellulose | 0.2-0.8 | 0.2-0.8 | 0.2-0.8 | 0.2-0.8 | 0.2-0.8 |
| Polymer[1] | 0.05-10 | 0.05-10 | 5.0 | 2.5 | 1.0 |
| Percarbonate | 0-10 | 0-10 | 0-10 | 0-10 | 0-10 |
| Nonanoyloxybenzenesulfonate | — | — | 0-2 | 0-2 | 0-2 |
| Tetraacetylethylenediamine | — | — | 0-0.6 | 0-0.6 | 0-0.6 |
| Zinc Phthalocyanine Tetrasulfonate | — | — | 0-0.005 | 0-0.005 | 0-0.005 |
| Brightener | 0.05-0.2 | 0.05-0.2 | 0.05-0.2 | 0.05-0.2 | 0.05-0.2 |
| $MgSO_4$ | — | — | 0-0.5 | 0-0.5 | 0-0.5 |
| Enzymes | 0-0.5 | 0-0.5 | 0-0.5 | 0-0.5 | 0-0.5 |
| Minors (perfume, dyes, suds stabilizers) | balance | balance | balance | balance | balance |

[1]An amphiphilic alkoxylated polyalkylenimine polymers according to any of Examples 1, 2, 3, or 4 or mixtures thereof.

Example 6

Granular Laundry Detergent

Aqueous Slurry Composition.

| Component | % w/w Aqueous slurry |
|---|---|
| A compound having the following general structure: bis($(C_2H_5O)(C_2H_4O)n$)($CH_3$)—$N^+$—$C_xH_{2x}$—$N^+$—($CH_3$)-bis($(C_2H_5O)(C_2H_4O)n$), wherein n = from 20 to 30, and x = from 3 to 8, or sulphated or sulphonated variants thereof | 1.23 |
| Ethylenediamine disuccinic acid | 0.35 |
| Brightener | 0.12 |
| Magnesium sulphate | 0.72 |
| Acrylate/maleate copolymer | 6.45 |
| Polymer[1] | 1.60 |
| Linear alkyl benzene sulphonate | 11.92 |
| Hydroxyethane di(methylene phosphonic acid) | 0.32 |
| Sodium carbonate | 4.32 |
| Sodium sulphate | 47.49 |
| Soap | 0.78 |
| Water | 24.29 |
| Miscellaneous | 0.42 |
| Total Parts | 100.00 |

[1]An amphiphilic alkoxylated polyalkylenimine polymer or any mixture of polymers according to any of Examples 1, 2, 3, or 4.

Preparation of a Spray-Dried Powder.

An aqueous slurry having the composition as described above is prepared having a moisture content of 25.89%. The aqueous slurry is heated to 72° C. and pumped under high pressure (from $5.5\times10^6$ $Nm^{-2}$ to $6.0\times10^6 Nm^{-2}$), into a counter current spray-drying tower with an air inlet temperature of from 270° C. to 300° C. The aqueous slurry is atomised and the atomised slurry is dried to produce a solid mixture, which is then cooled and sieved to remove oversize material (>1.8 mm) to form a spray-dried powder, which is free-flowing. Fine material (<0.15 mm) is elutriated with the exhaust the exhaust air in the spray-drying tower and collected in a post tower containment system. The spray-dried powder has a moisture content of 1.0 wt %, a bulk density of 427 g/l and a particle size distribution such that 95.2 wt % of the spray-dried powder has a particle size of from 150 to 710 micrometers. The composition of the spray-dried powder is given below.

Spray-Dried Powder Composition.

| Component | % w/w Spray-dried powder |
|---|---|
| A compound having the following general structure: bis($(C_2H_5O)(C_2H_4O)n$)($CH_3$)—$N^+$—$C_xH_{2x}$—$N^+$—($CH_3$)-bis($(C_2H_5O)(C_2H_4O)n$), wherein n = from 20 to 30, and x = from 3 to 8, or sulphated or sulphonated variants thereof | 1.62 |
| Ethylenediamine disuccinic acid | 0.46 |
| Brightener | 0.16 |
| Magnesium sulphate | 0.95 |
| Acrylate/maleate copolymer | 8.45 |
| Polymer[1] | 2.09 |
| Linear alkyl benzene sulphonate | 15.65 |
| Hydroxyethane di(methylene phosphonic acid) | 0.42 |
| Sodium carbonate | 5.65 |
| Sodium sulphate | 61.98 |
| Soap | 1.02 |

-continued

| Component | % w/w Spray-dried powder |
|---|---|
| Water | 1.00 |
| Miscellaneous | 0.55 |
| Total Parts | 100.00 |

[1]An amphiphilic alkoxylated polyalkylenimine polymer or any mixture of polymers according to any of Examples 1, 2, 3, or 4.

Preparation of an Anionic Surfactant Particle 1

The anionic detersive surfactant particle 1 is made on a 520 g batch basis using a Tilt-A-Pin then Tilt-A-Plow mixer (both made by Processall). 108 g sodium sulphate supplied is added to the Tilt-A-Pin mixer along with 244 g sodium carbonate. 168 g of 70% active $C_{25}E_3S$ paste (sodium ethoxy sulphate based on $C_{12/15}$ alcohol and ethylene oxide) is added to the Tilt-A-Pin mixer. The components are then mixed at 1200 rpm for 10 seconds. The resulting powder is then transferred into a Tilt-A-Plow mixer and mixed at 200 rpm for 2 minutes to form particles. The particles are then dried in a fluid bed dryer at a rate of 25001/min at 120° C. until the equilibrium relative humidity of the particles is less than 15%. The dried particles are then sieved and the fraction through 1180 μm and on 250 μm is retained The composition of the anionic detersive surfactant particle 1 is as follows:

25.0% w/w $C_{25}E_3S$ sodium ethoxy sulphate 18.0% w/w sodium sulphate 57.0% w/w sodium carbonate Preparation of a Cationic Detersive Surfactant Particle 1

The cationic surfactant particle 1 is made on a 14.6 kg batch basis on a Morton FM-50 Loedige mixer. 4.5 kg of micronised sodium sulphate and 4.5 kg micronised sodium carbonate are premixed in the Morton FM-50 Loedige mixer. 4.6 kg of 40% active mono-$C_{12-14}$ alkyl mono-hydroxyethyl di-methyl quaternary ammonium chloride (cationic surfactant) aqueous solution is added to the Morton FM-50 Loedige mixer whilst both the main drive and the chopper are operating. After approximately two minutes of mixing, a 1.0 kg 1:1 weight ratio mix of micronised sodium sulphate and micronised sodium carbonate is added to the mixer. The resulting agglomerate is collected and dried using a fluid bed dryer on a basis of 25001/min air at 100-140° C. for 30 minutes. The resulting powder is sieved and the fraction through 1400 cm is collected as the cationic surfactant particle 1. The composition of the cationic surfactant particle 1 is as follows:

15% w/w mono-$C_{12-14}$ alkyl mono-hydroxyethyl di-methyl quaternary ammonium chloride 40.76% w/w sodium carbonate 40.76% w/w sodium sulphate 3.48% w/w moisture and miscellaneous Preparation of a Granular Laundry Detergent Composition 10.84 kg of the spray-dried powder of example 6, 4.76 kg of the anionic detersive surfactant particle 1, 1.57 kg of the cationic detersive surfactant particle 1 and 7.83 kg (total amount) of other individually dosed dry-added material are dosed into a 1 m diameter concrete batch mixer operating at 24 rpm. Once all of the materials are dosed into the mixer, the mixture is mixed for 5 minutes to form a granular laundry detergent composition. The formulation of the granular laundry detergent composition is described below:

A Granular Laundry Detergent Composition.

| Component | % w/w granular laundry detergent composition |
|---|---|
| Spray-dried powder from earlier table in Example 6 | 43.34 |
| 91.6 wt % active linear alkyl benzene sulphonate flake supplied by Stepan under the tradename Nacconol 90G ® | 0.22 |
| Citric acid | 5.00 |
| Sodium percarbonate (having from 12% to 15% active AvOx) | 14.70 |
| Photobleach particle | 0.01 |
| Lipase (11.00 mg active/g) | 0.70 |
| Amylase (21.55 mg active/g) | 0.33 |
| Protease (56.00 mg active/g) | 0.43 |
| Tetraacetyl ethylene diamine agglomerate (92 wt % active) | 4.35 |
| Suds suppressor agglomerate (11.5 wt % active) | 0.87 |

-continued

| Component | % w/w granular laundry detergent composition |
|---|---|
| Acrylate/maleate copolymer particle (95.7 wt % active) | 0.29 |
| Green/Blue carbonate speckle | 0.50 |
| Anionic detersive surfactant particle 1 | 19.04 |
| Cationic detersive surfactant particle 1 | 6.27 |
| Sodium sulphate | 3.32 |
| Solid perfume particle | 0.63 |
| Total Parts | 100.00 |

Example 9

Liquid Laundry Detergents

| Ingredient | A wt % | B wt % | C wt % | D wt % | E wt % |
|---|---|---|---|---|---|
| Sodium alkyl ether sulfate | 14.4% | | 9.2% | 5.4% | |
| Linear alkylbenzene sulfonic acid | 4.4% | 12.2% | 5.7% | 1.3% | |
| Alkyl ethoxylate | 2.2% | 8.8% | 8.1% | 3.4% | |
| Amine oxide | 0.7% | 1.5% | | | |
| Citric acid | 2.0% | 3.4% | 1.9% | 1.0% | 1.6% |
| Fatty acid | 3.0% | 8.3% | | | 16.0% |
| Protease | 1.0% | 0.7% | 1.0% | | 2.5% |
| Amylase | 0.2% | 0.2% | | | 0.3% |
| Lipase | | | 0.2% | | |
| Borax | 1.5% | 2.4% | 2.9% | | |
| Calcium and sodium formate | 0.2% | | | | |
| Formic acid | | | | | 1.1% |
| Polymer[1] | 1.8% | 2.1% | | | 3.2% |
| Sodium polyacrylate | | | | 0.2% | |
| Sodium polyacrylate copolymer | | | 0.6% | | |
| DTPA[2] | 0.1% | | | | 0.9% |
| DTPMP[3] | | 0.3% | | | |
| EDTA[4] | | | | 0.1% | |
| Fluorescent whitening agent | 0.15% | 0.2% | 0.12% | 0.12% | 0.2% |
| Ethanol | 2.5% | 1.4% | 1.5% | | |
| Propanediol | 6.6% | 4.9% | 4.0% | | 15.7% |
| Sorbitol | | | 4.0% | | |
| Ethanolamine | 1.5% | 0.8% | 0.1% | | 11.0% |
| Sodium hydroxide | 3.0% | 4.9% | 1.9% | 1.0% | |
| Sodium cumene sulfonate | | 2.0% | | | |
| Silicone suds suppressor | | 0.01% | | | |
| Perfume | 0.3% | 0.7% | 0.3% | 0.4% | 0.6% |
| Opacifier[5] | | 0.30% | 0.20% | | 0.50% |
| Water | balance | balance | balance | balance | balance |
| | 100.0% | 100.0% | 100.0% | 100.0% | 100.0% |

[1]An amphiphilic alkoxylated polyalkylenimine polymer or any mixture of polymers according to any of Examples 1, 2, 3, or 4.

[2]diethylenetriaminepentaacetic acid, sodium salt

[3]diethylenetriaminepentakismethylenephosphonic acid, sodium salt

[4]ethylenediaminetetraacetic acid, sodium salt

[5]Acusol OP 301

| Ingredient | F wt % | G wt % | H wt % | I wt % | J wt % | K wt % |
|---|---|---|---|---|---|---|
| Alkylbenzene sulfonic acid | 7 | 7 | 4.5 | 1.2 | 1.5 | 12.5 |
| Sodium C12-14 alkyl ethoxy 3 sulfate | 2.3 | 2.3 | 4.5 | 4.5 | 7 | 18 |
| C14-15 alkyl 8-ethoxylate | 5 | 5 | 2.5 | 2.6 | 4.5 | 4 |
| C12 alkyl dimethyl amine oxide | — | 2 | — | — | — | — |
| C12-14 alkyl hydroxyethyl dimethyl ammonium chloride | — | — | — | 0.5 | — | — |
| C12-18 Fatty acid | 2.6 | 3 | 4 | 2.6 | 2.8 | 11 |
| Citric acid | 2.6 | 2 | 1.5 | 2 | 2.5 | 3.5 |
| Protease enzyme | 0.5 | 0.5 | 0.6 | 0.3 | 0.5 | 2 |
| Amylase enzyme | 0.1 | 0.1 | 0.15 | — | 0.05 | 0.5 |
| Mannanase enzyme | 0.05 | — | 0.05 | — | — | 0.1 |
| Alkoxylated Polyalkylenimine Polymer[1] | 1.0 | .8 | 1 | 0.4 | 1.5 | 2.7 |
| Diethylenetriaminepenta (methylenephosphonic) acid | 0.2 | 0.3 | — | — | 0.2 | — |
| Hydroxyethane diphosphonic acid | — | — | 0.45 | — | — | 1.5 |
| FWA | 0.1 | 0.1 | 0.1 | — | — | 0.2 |
| Solvents (1,2 propanediol, ethanol), stabilizers | 3 | 4 | 1.5 | 1.5 | 2 | 4.3 |
| Hydrogenated castor oil derivative structurant | 0.4 | 0.3 | 0.3 | 0.1 | 0.3 | — |
| Boric acid | 1.5 | 2 | 2 | 1.5 | 1.5 | 0.5 |
| Na formate | — | — | — | 1 | — | — |
| Reversible protease inhibitor[3] | — | — | 0.002 | — | — | — |
| Perfume | 0.5 | 0.7 | 0.5 | 0.5 | 0.8 | 1.5 |
| Buffers (sodium hydroxide, Monoethanolamine) | To pH 8.2 | | | | | |
| Water and minors (antifoam, aesthetics, . . . ) | To 100 | | | | | |

[1]Amphiphilic alkoxylated polyalkylenimine polymer or any mixture of polymers according to any of Examples 1, 2, 3, or 4.

| Ingredient | L wt % | M wt % | N wt % | O wt % | P wt % | Q wt % |
|---|---|---|---|---|---|---|
| Alkylbenzene sulfonic acid | 5.5 | 2.7 | 2.2 | 12.2 | 5.2 | 5.2 |
| Sodium C12-14 alkyl ethoxy 3 sulfate | 16.5 | 20 | 9.5 | 7.7 | 1.8 | 1.8 |
| Sodium C12-14 alkyl sulfate | 8.9 | 6.5 | 2.9 | — | | |
| C12-14 alkyl 7-ethoxylate | | | | | 0.15 | 0.15 |
| C14-15 alkyl 8-ethoxylate | | | | | 3.5 | 3.5 |
| C12-15 alkyl 9-ethoxylate | 1.7 | 0.8 | 0.3 | 18.1 | — | — |
| C12-18 Fatty acid | 2.2 | 2.0 | — | 1.3 | 2.6 | 2.6 |
| Citric acid | 3.5 | 3.8 | 2.2 | 2.4 | 2.5 | 2.5 |
| Protease enzyme | 1.7 | 1.4 | 0.4 | — | 0.5 | 0.5 |
| Amylase enzyme | 0.4 | 0.3 | — | — | 0.1 | 0.1 |
| Mannanase enzyme | | | | | 0.04 | 0.04 |
| Alkoxylated Polyalkylenimine Polymer[1] | 2.1 | 1.2 | 1.0 | 2 | 1.00 | 0.25 |
| PEG-PVAc Polymer[2] | — | — | — | — | — | 0.3 |
| Ethoxysulfated Hexamethylene Diamine Dimethyl Quat | — | — | — | — | — | 0.7 |
| Diethylenetriaminepenta (methylenephosphonic) acid | | | | | 0.2 | 0.2 |
| FWA | — | — | — | — | .04 | .04 |
| Solvents (1,2 propanediol, ethanol, stabilizers | 7 | 7.2 | 3.6 | 3.7 | 1.9 | 1.9 |
| Hydrogenated castor oil derivative structurant | 0.3 | 0.2 | 0.2 | 0.2 | 0.35 | 0.35 |
| Polyacrylate | — | — | — | 0.1 | — | — |
| Polyacrylate copolymer[3] | — | — | — | 0.5 | — | — |
| Sodium carbonate | — | — | — | 0.3 | — | — |
| Sodium silicate | — | — | — | — | — | — |
| Borax | 3 | 3 | 2 | 1.3 | — | — |
| Boric acid | 1.5 | 2 | 2 | 1.5 | 1.5 | 1.5 |
| Perfume | 0.5 | 0.5 | 0.5 | 0.8 | 0.5 | 0.5 |

-continued

| Ingredient | L wt % | M wt % | N wt % | O wt % | P wt % | Q wt % |
|---|---|---|---|---|---|---|
| Buffers (sodium hydroxide, monoethanolamine) | | | | | 3.3 | 3.3 |
| Water, dyes and miscellaneous | | | Balance | | | |

[1]Amphiphilic alkoxylated polyalkylenimine polymer or any mixture of polymers according to any of Examples 1, 2, 3, or 4.
[2]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.
[3]Alco 725 (styrene/acrylate)

Example 10

Liquid Dish Handwashing Detergents

| Composition | A | B |
|---|---|---|
| $C_{12-13}$ Natural AE0.6S | 29.0 | 29.0 |
| $C_{10-14}$ mid-branched Amine Oxide | — | 6.0 |
| $C_{12-14}$ Linear Amine Oxide | 6.0 | — |
| SAFOL ® 23 Amine Oxide | 1.0 | 1.0 |
| $C_{11}E_9$ Nonionic[2] | 2.0 | 2.0 |
| Ethanol | 4.5 | 4.5 |
| Polymer[1] | 5.0 | 2.0 |
| Sodium cumene sulfonate | 1.6 | 1.6 |
| Polypropylene glycol 2000 | 0.8 | 0.8 |
| NaCl | 0.8 | 0.8 |
| 1,3 BAC Diamine[3] | 0.5 | 0.5 |
| Suds boosting polymer[4] | 0.2 | 0.2 |
| Water | Balance | Balance |

[1]An amphiphilic alkoxylated polyalkylenimine polymer or any mixture of polymers according to any of Examples 1, 2, 3, or 4.
[2]Nonionic may be either $C_{11}$ Alkyl ethoxylated surfactant containing 9 ethoxy groups.
[3]1,3, BAC is 1,3 bis(methylamine)-cyclohexane.
[4](N,N-dimethylamino)ethyl methacrylate homopolymer

Example 11

Automatic Dishwasher Detergent

| | A | B | C | D | E |
|---|---|---|---|---|---|
| Polymer dispersant[2] | 0.5 | 5 | 6 | 5 | 5 |
| Carbonate | 35 | 40 | 40 | 35-40 | 35-40 |
| Sodium tripolyphosphate | 0 | 6 | 10 | 0-10 | 0-10 |
| Silicate solids | 6 | 6 | 6 | 6 | 6 |
| Bleach and bleach activators | 4 | 4 | 4 | 4 | 4 |
| Polymer[1] | 0.05-10 | 1 | 2.5 | 5 | 10 |
| Enzymes | 0.3-0.6 | 0.3-0.6 | 0.3-0.6 | 0.3-0.6 | 0.3-0.6 |
| Disodium citrate dihydrate | 0 | 0 | 0 | 2-20 | 0 |
| Nonionic surfactant[3] | 0 | 0 | 0 | 0 | 0.8-5 |
| Water, sulfate, perfume, dyes and other adjuncts | Balance to 100% | Balance to 100% | Balance to 100% | Balance to 100% | Balance to 100% |

[1]An amphiphilic alkoxylated polyalkylenimine polymer or any mixture of polymers according to any of Examples 1, 2, 3, or 4.
[2]Such as ACUSOL ® 445N available from Rohm & Haas or ALCOSPERSE ® from Alco.
[3]Such as SLF-18 POLY TERGENT from the Olin Corporation.

Example 12

Liquid Laundry Detergent Composition in the Form of a Pouch, being Encapsulated by a Film of Polyvinyl Alcohol

| | A | B 3 compartments pouched product | | |
|---|---|---|---|---|
| | Compartment # | | | |
| | 1 | 1 | 2 | 3 |
| Dosage (g) | 36.0 | 34.0 | 3.5 | 3.5 |
| Alkylbenzene sulfonic acid | 14.5 | 14.5 | 20.0 | |
| C12-14 alkyl ethoxy 3 sulfate | 8.5 | 8.5 | | |
| C12-14 alkyl 7-ethoxylate | 12.5 | 12.5 | 17.0 | |
| C12-18 Fatty acid | 14.5 | 14.5 | 13.0 | |
| Protease enzyme | 1.5 | 1.5 | | |
| Amylase enzyme | 0.2 | | | |
| Mannanase enzyme | 0.1 | | | |
| PAP granule[1] | | | | 50.0 |
| Alkoxylated Polyalkylenimine Polymer[2] | 1.5 | 2.0 | | |
| Ethoxysulfated Hexamethylene Diamine Dimethyl Quat | 3.0 | | 2.2 | |
| PEG-PVAc Polymer[3] | | | 2.5 | |
| Hydroxyethane diphosphonic acid | 1.0 | 0.6 | 0.6 | |
| Brightener | 0.2 | 0.2 | 0.2 | |
| Solvents (1,2 propanediol, ethanol), stabilizers | 20 | 20 | 25 | 30.0 |
| Hydrogenated castor oil derivative structurant | 0.1 | | 0.05 | |
| Perfume | 1.8 | 1.7 | | |
| Buffers (sodium hydroxide, monoethanolamine) | To pH 8.0 for liquid | | | |
| Water and minors (antioxidant, aesthetics, . . . ) | To 100p | | | |

[1]PAP = Phtaloyl-Amino-Peroxycaproic acid, as a 70% active wet cake

[2]Amphiphilic alkoxylated polyalkylenimine polymer or any mixture of polymers according to any of Examples 1, 2, 3, or 4.

[3]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units Unless otherwise noted, all component or composition levels are in reference to the active level of that component or composition, and are exclusive of impurities, for example, residual solvents or by-products, which may be present in commercially available sources.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A laundry detergent or cleaning composition which comprises an amphiphilic water-soluble alkoxylated polyalkylenimine polymer comprising in condensed form repeating units of formulae (I), (II), (III) and (IV)

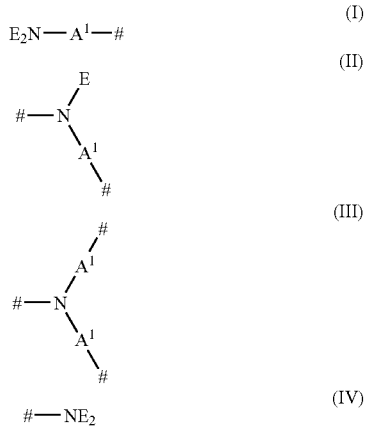

(I)

(II)

(III)

(IV)

wherein in each case denotes one-half of a bond between a nitrogen atom and the free binding position of a group $A^1$ of two adjacent repeating units of formulae (I), (II), (III) or (IV);

$A^1$ is independently selected from linear or branched $C_2$-$C_6$-alkylene;

E is independently selected from alkylenoxy units of the formula (V)

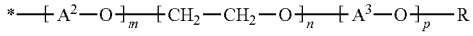

(V)

wherein

* in each case denotes one-half of a bond to the nitrogen atom of the repeating unit of formula (I), (II) or (IV);

$A^2$ is in each case independently selected from 1,2-propylene, 1,2-butylene and 1,2-isobutylene;

$A^3$ is 1,2-propylene;

R is in each case independently selected from hydrogen and $C_1$-$C_4$-alkyl;

m has an average value in the range of from 0 to about 2;

n has an average value in the range of from about 20 to about 50; and p has an average value in the range of from about 10 to about 50;

wherein the individual alkoxylated polyalkylenimines consisting of 1 repeating unit of formula (I), x repeating units of formula (II), y repeating units of formula (III) and y+1 repeating units of formula (IV), wherein x and y in each case have a value in the range of from 0 to about 150; and the polymer having a backbone comprising the combined repeating units of formulae (I), (II), (III) and (IV) excluding the alkylenoxy units E, where the average molecular weight, Mw, of the polyalkylenimine backbone in each case having a value in the range of from about 60 to about 10,000 g/mol; and the polymer comprising a degree of quaternization ranging from 0 to about 50.

2. A laundry detergent or cleaning composition according to claim 1 wherein the laundry detergent or cleaning composition is selected from the group consisting of liquid laundry detergent compositions, solid laundry detergent compositions, hard surface cleaning compositions, liquid hand dishwashing compositions, solid automatic dishwashing compositions, liquid automatic dishwashing, and tab/unit dose form automatic dishwashing compositions laundry detergent compositions containing in a water-soluble pouch.

3. A laundry detergent or cleaning composition according to claim 1 wherein the detergent or cleaning composition comprises from about 0.05 to about 10% by weight of the detergent or cleaning composition, of the alkoxylated polyalkylenimine polymer.

4. A laundry detergent or cleaning composition according to claim 1 wherein the amphiphilic water-soluble alkoxylated polyalkylenimine polymer has an average ratio of n to p in the range of from about 0.6 to about $1.5(x+2y+1)^{1/2}$.

5. A laundry detergent or cleaning composition according to claim 1 wherein m is zero.

6. A laundry detergent or cleaning composition according to claim 1 wherein n has an average value of from about 22 to about 40 and p has an average value of from about 11 to about 40.

7. A laundry detergent or cleaning composition according to claim 1 wherein the $A^1$ is ethylene.

8. A laundry detergent or cleaning composition according to claim 1 wherein R is hydrogen.

9. A laundry detergent or cleaning composition according to claim 1 wherein $A^1$ is ethylene, m is zero, R is hydrogen, n has an average value of from about 24 to about 30, p has an average value of from about 12 to about 30, the ratio of n to p has an average value of from about 0.8 to about $1.2(x+2Y+1)^{1/2}$, the molecular weight of the polyalkylenimine backbone has an average value of from about 500 to about 6,000, and has a degree of substitution ranging from about 5% to about 40%.

10. A laundry detergent or cleaning composition according to claim 1 wherein the detergent or composition further comprises a surfactant system.

11. A laundry detergent or cleaning composition according to claim 10 wherein the surfactant system comprises $C_{10}$-$C_{16}$ alkyl benzene sulfonates.

12. A laundry detergent or cleaning composition according to claim 10 wherein the surfactant system comprises $C_8$-$C_{18}$ linear alkyl sulfonate surfactant.

13. A laundry detergent or cleaning composition according to claim 11 wherein the surfactant system further comprises one or more co-surfactant selected from the groups consisting of nonionic surfactants, cationic surfactants, anionic surfactants and mixtures thereof.

14. A laundry detergent or cleaning composition according to claim 10 wherein the detergent or composition further comprises cleaning adjunct additives.

15. A cleaning implement comprising a nonwoven substrate and the laundry detergent or cleaning composition according to claim 1.

* * * * *